US009011178B2

(12) United States Patent
Hori et al.

(10) Patent No.: US 9,011,178 B2
(45) Date of Patent: Apr. 21, 2015

(54) CONNECTOR AND METHOD OF MANUFACTURING SAME

(75) Inventors: Kiichi Hori, Kanagawa (JP); Yoshihito Ohkuma, Kanagawa (JP)

(73) Assignee: Iriso Electronics Co., Ltd, Kanagawa (JP)

( * ) Notice: Subject to any disclaimer, the term of this patent is extended or adjusted under 35 U.S.C. 154(b) by 274 days.

(21) Appl. No.: 13/643,748

(22) PCT Filed: Apr. 20, 2011

(86) PCT No.: PCT/JP2011/059725

§ 371 (c)(1), (2), (4) Date: Dec. 7, 2012

(87) PCT Pub. No.: WO2011/136103

PCT Pub. Date: Mar. 11, 2011

(65) Prior Publication Data

US 2013/0078859 A1 Mar. 28, 2013

(30) Foreign Application Priority Data

Apr. 27, 2010 (JP) ..... 2010-102055

(51) Int. Cl.
*H01R 9/03* (2006.01)
*H01R 13/648* (2006.01)
(Continued)

(52) U.S. Cl.
CPC ..... *H01R 13/6581* (2013.01); *H01R 43/20* (2013.01); *H01R 43/16* (2013.01)

(58) Field of Classification Search
CPC ..... H01R 13/6581; H01R 43/20; H01R 43/16
USPC ..... 439/607.55, 607.04, 607.05, 607.07, 439/607.09, 607.11, 607.13, 607.17, 439/607.23, 607.24, 607.27, 607.34, 439/607.36, 607.37, 607.4, 620.11, 620.12, 439/620.19, 660, 541.5, 540.1; 29/842, 29/854, 874, 876, 882
See application file for complete search history.

(56) References Cited

U.S. PATENT DOCUMENTS 6,388,722 B1 * 5/2002 Yoshii et al. ..... 349/62
6,827,610 B2 * 12/2004 Lin ..... 439/607.37
(Continued)

FOREIGN PATENT DOCUMENTS

JP 1999086975 A 3/1999
JP 2003288967 A 10/2003
(Continued)

OTHER PUBLICATIONS

International Search Report.

*Primary Examiner* — Abdullah Riyami
*Assistant Examiner* — Harshad Patel
(74) *Attorney, Agent, or Firm* — Lowe Hauptman & Ham, LLP

(57) ABSTRACT

A connector which permits the resistance against the deformation of a shield to be increased and a method of manufacturing the connector. The shield is made up of an inner shield member disposed on the inner surface side of the shield and anouter shield member disposed on the outer surface side and, therefore, the strength of the shield can be increased by the double structure of the shield members. As a result of this, the shield is not deformed easily even in the case where an excessive external force is applied to the shield in the vertical direction or in the horizontal direction, for example, in inserting and extracting a mating connector into and out of the shield.

14 Claims, 9 Drawing Sheets

(51) Int. Cl.

| | |
|---|---|
| ***H01R 9/00*** | (2006.01) |
| ***H01R 13/6581*** | (2011.01) |
| ***H01R 43/20*** | (2006.01) |
| ***H01R 43/16*** | (2006.01) |

(56) References Cited

U.S. PATENT DOCUMENTS

| | | | | |
|---|---|---|---|---|
| 6,997,748 | B1 * | 2/2006 | Su | 439/607.55 |
| 7,513,786 | B2 * | 4/2009 | Muroi et al. | 439/248 |
| 7,922,534 | B2 * | 4/2011 | Lin et al. | 439/607.27 |
| 8,535,097 | B2 * | 9/2013 | Yen et al. | 439/607.27 |

FOREIGN PATENT DOCUMENTS

| | | | |
|---|---|---|---|
| JP | 2007180004 | A | 12/2007 |
| JP | 2008243536 | A | 9/2008 |
| WO | 2007000814 | A1 | 4/2007 |

* cited by examiner

CONNECTOR AND METHOD OF MANUFACTURING SAME

TECHNICAL FIELD

The present invention relates to a connector which is used, for example, as a communication interface of electrical equipment by being connected to a mating connector and a method of manufacturing the connector.

BACKGROUND ART

In recent years, a UBS (universal serial bus), an HDMI (High-Definition Multimedia Interface: registered trademark) and the like have been used as communication interfaces of electrical equipment, such as a computer and a television receiver.

As such a connector used in communication interfaces there is known a connector which is provided with a plurality of terminals disposed at mutual widthwise intervals, a terminal holding member with insulating properties which holds each terminal, and a metallic shield which covers the terminal holding member holding each terminal and is adapted to be connected to a mating connector by inserting the mating connector into an opening provided on a front surface of the shield (for example, refer to Patent Literature 1).

CITATION LIST

Patent Literature

Patent Literature 1: Japanese Patent Publication 2003-288967

SUMMARY OF INVENTION

Technical Problem

In the above-described connector, a long metal plate is bent in the width direction of a shield, and a shield in the form of an angular cylinder is formed by abutting both ends of the metal plate in the middle of the shield. In inserting and extracting a mating connector into and out of the shield, the shield may be deformed if an excessive external force is applied from the mating connector to the shield in the vertical direction or in the horizontal direction, for example, in the case where the mating connector inclines. That is, because the shield of the above-described connector is fabricated by abutting both ends of the bent metal plate, in the case where a horizontal force is applied from the mating connector to the inner surface of the shield, the abutting end portions of the metal plate open and the opening of the shield is apt to be deformed to the outside in the width direction, posing the problem that strength against such deformation is insufficient.

The present invention was made in view of the above-described problem and the object of the invention is to provide a connector which permits the strength against the deformation of a shield to be increased and a method of manufacturing the connector.

Solution to Problem

In order to achieve the above-described object, the present invention provides a connector which comprises a plurality of terminals disposed at mutual widthwise intervals, a terminal holding member having insulating properties which holds each terminal, and a shield which covers the terminal holding member holding each terminal, and is adapted to be connected to a mating connector by inserting the mating connector into an opening provided on a front surface of the shield, in which the shield comprises an inner shield member disposed on the inner surface side of the shield and an outer shield member disposed on the outer surface side of the shield, and the inner shield member and the outer shield member are formed to be integral with each other by a bent metal plate.

Also, in order to achieve the above-described object, the present invention provides a method of manufacturing a connector which comprises a plurality of terminals disposed at mutual widthwise intervals, a terminal holding member having insulating properties which holds each terminal, and a shield which covers the terminal holding member holding each terminal, and in which the shield comprises an inner shield member disposed on the inner surface side of the shield and an outer shield member disposed on the outer surface side of the shield, in which a first plate-like portion which becomes the inner shield member and a second plate-like portion which becomes the outer shield member are integrally formed on a metal plate, the inner shield member is formed by bending the first plate-like portion into the shape of a cylinder, and the outer shield member is formed by bending sides of both ends of the second plate-like portion in the width direction at right angles and folding the outer shield member on the inner shield member.

As a result of this, although in the case where the mating connector inclines, for example, in inserting and extracting a mating connector into and out of the shield and an excessive external force is applied from the mating connector to the shield in the vertical direction or in the horizontal direction, the shield is not deformed easily because the shield has the double structure of the inner shield member and the outer shield member. Furthermore, as the inner shield member and outer shield member of the shield are formed from a bent metal plate integrally with each other, the number of parts does not increase.

Advantageous Effects of Invention

According to the present invention, because the shield is not deformed easily even if an excessive vertical or horizontal external force is applied to the shield, it is possible to effectively prevent the occurrence of a poor connection to the mating connector due to the deformation of the shield. Furthermore, because the number of parts does not increase even when the shield is formed from the inner shield member and the outer shield member, the shield can be easily manufactured as an integral part.

DESCRIPTION OF EMBODIMENTS

Figure 1:
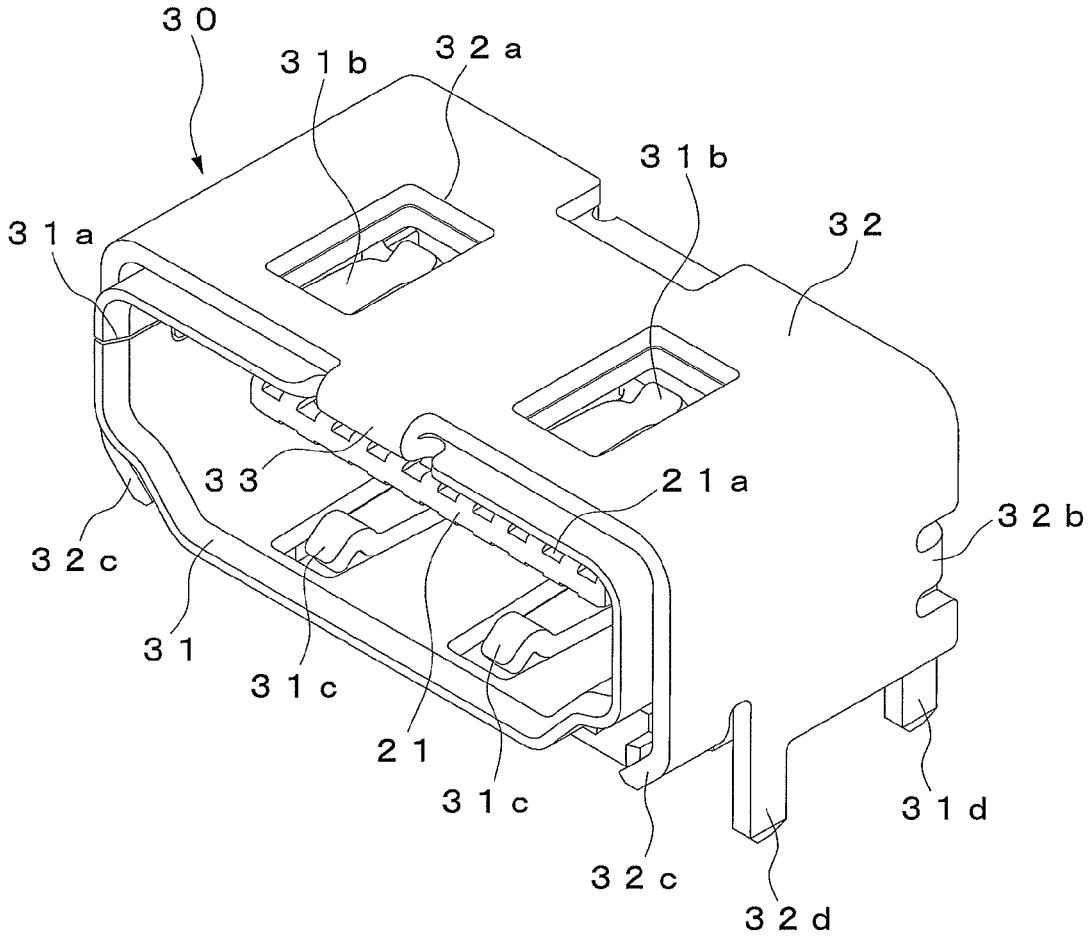
FIG. 1 is a perspective view of the front side of a connector showing an embodiment of the present invention.
Figure 2:
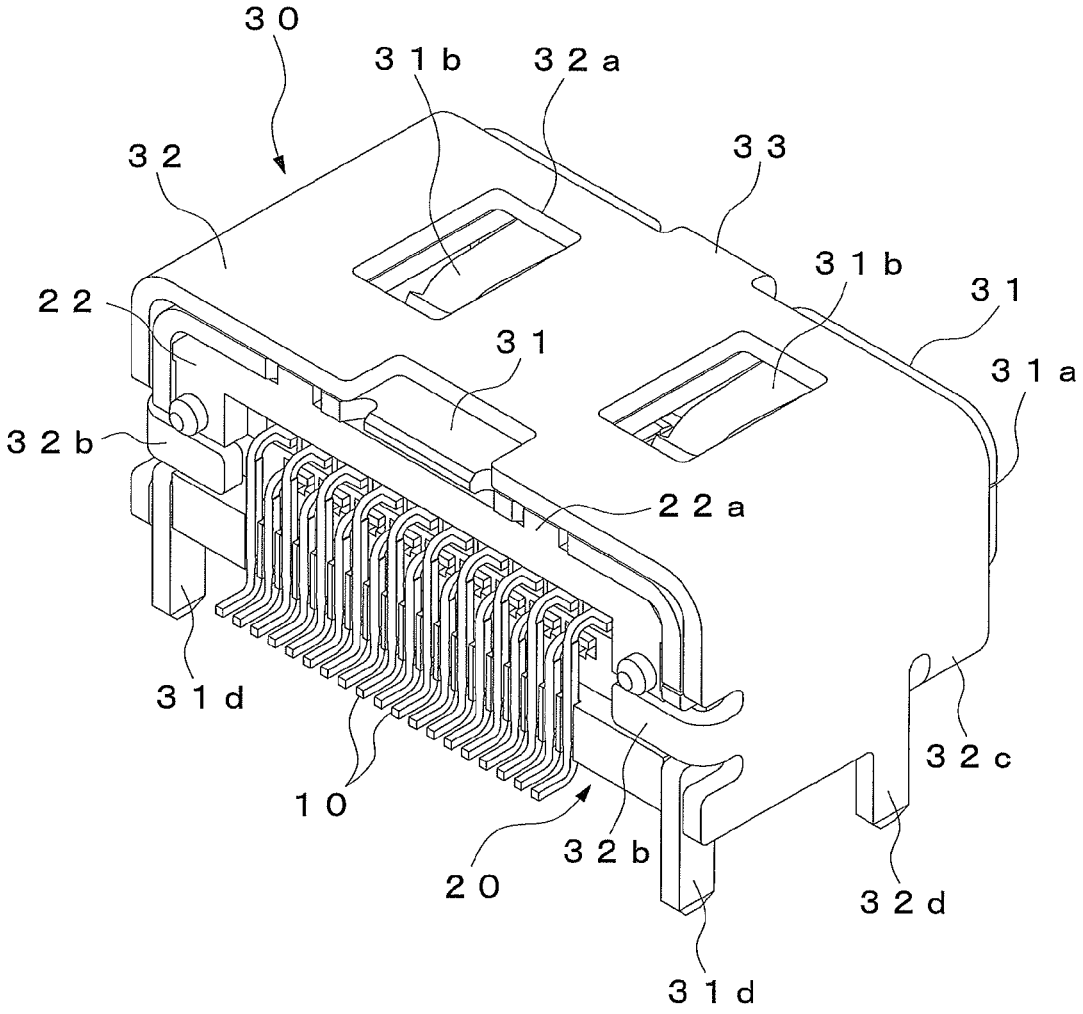
FIG. 2 is a perspective view of the rear side of the connector.
Figure 3:
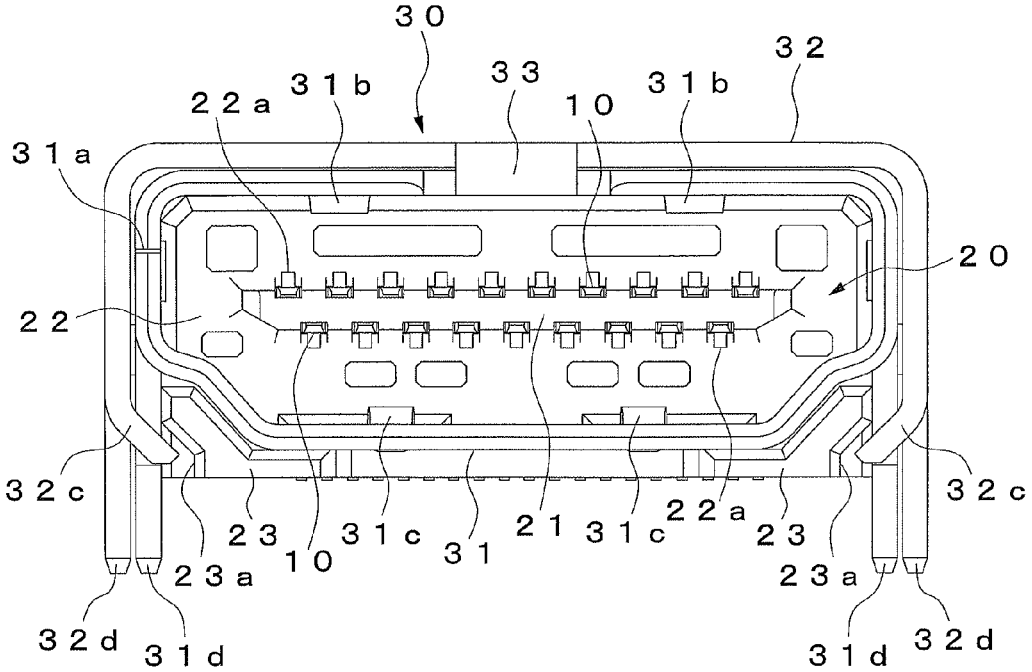
FIG. 3 is a front view of the connector.
Figure 4:
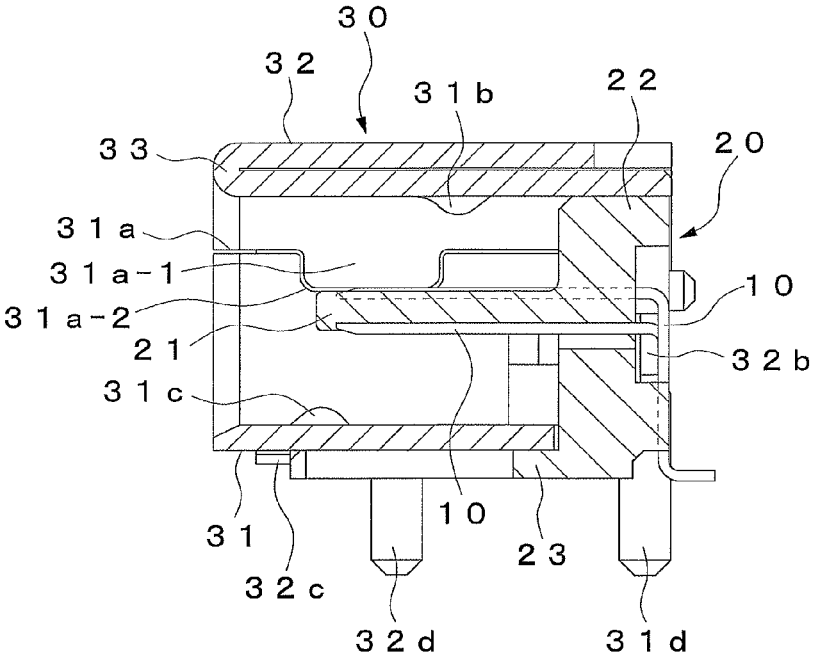
FIG. 4 is a side sectional view of the connector.
Figure 5:
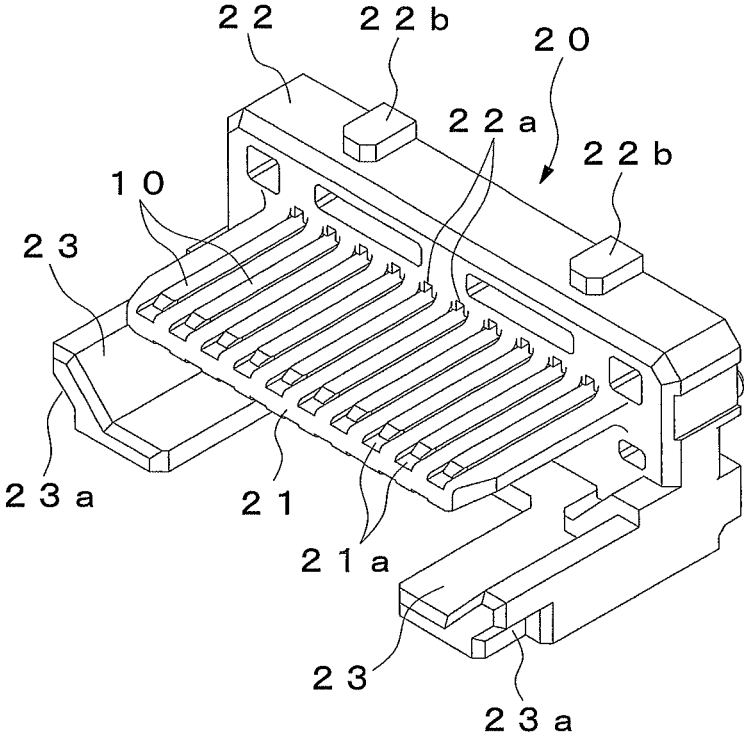
FIG. 5 is a perspective view of a housing.
Figure 6:
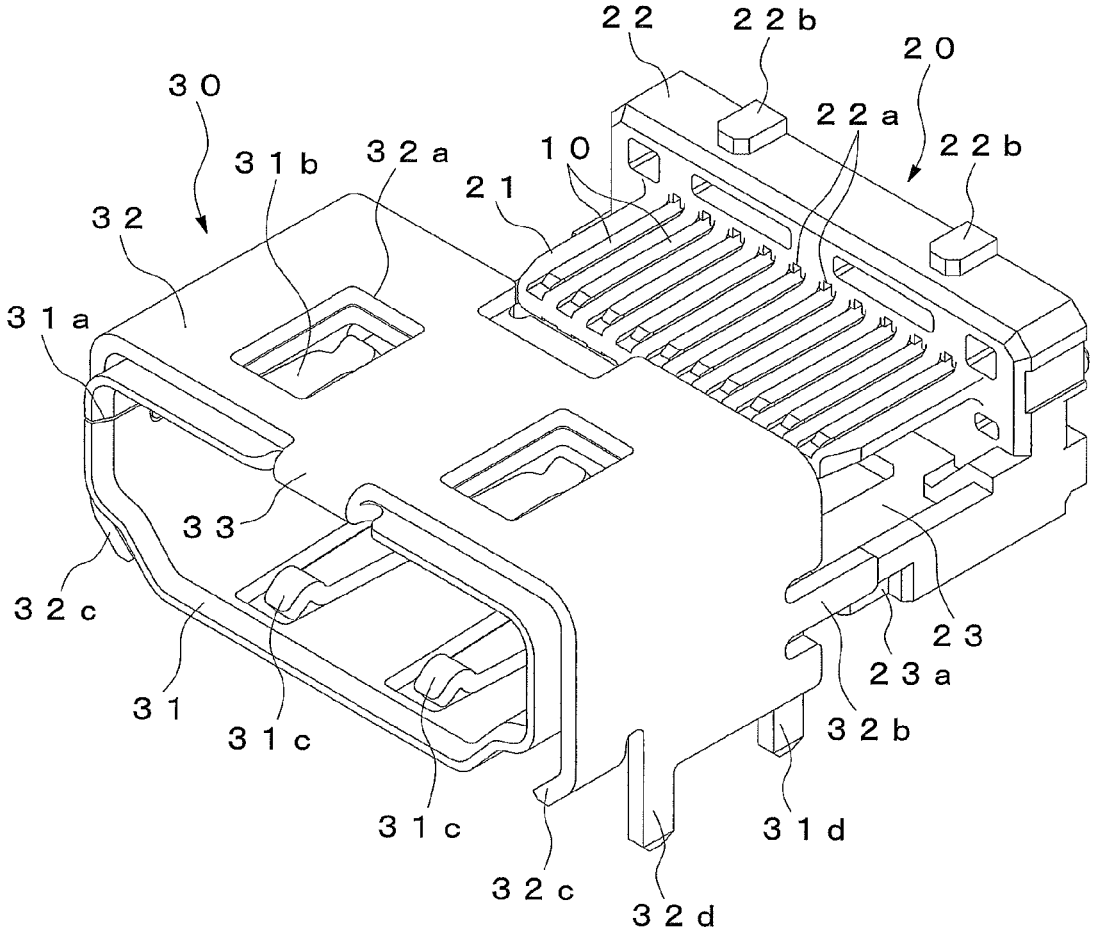
FIG. 6 is an exploded perspective view of the upper surface side of the connector.
Figure 7:
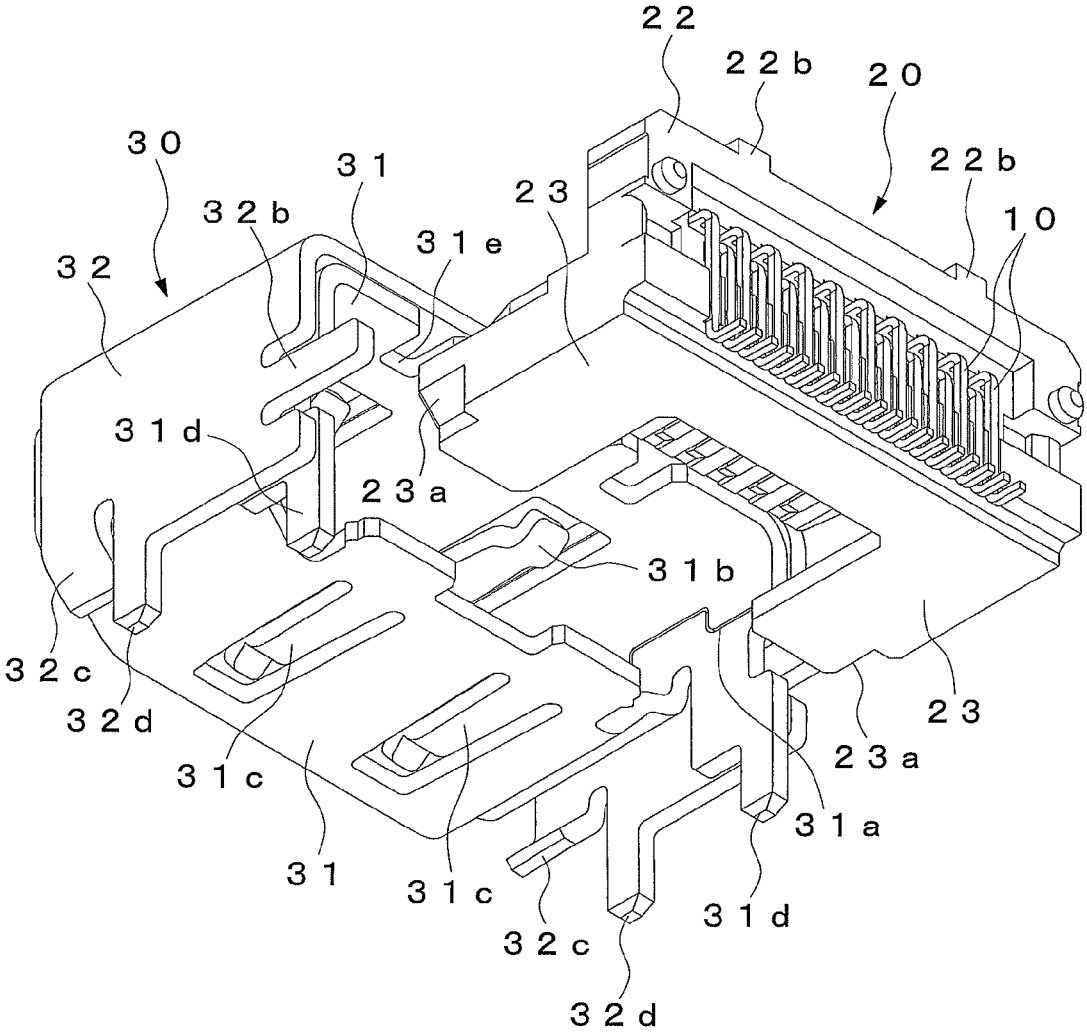
FIG. 7 is an exploded perspective view of the lower surface side of the connector.

FIGS. 1 to 8 show an embodiment of the present invention. The connector shown in the figures is to be mounted on a printed circuit board as an object of attachment and is intended for use by being connected to a mating connector.

The connector of this embodiment is made up of a plurality of terminals 10 disposed at mutual widthwise intervals, a housing 20 having insulating properties as a terminal holding member which holds each terminal 10, and a shield 30 which covers the housing 20 holding each terminal 10.

Each of the terminals 10 is formed from a metallic member having electrical conductivity and is formed in such a manner that the side of one end extends in the front-back direction and the side of the other end is bent downward in the shape of the letter L. The terminals 10 are disposed in such a manner as to form a double row of upper and lower rows. The upper terminals 10 and the lower terminals 10 are disposed in such a manner that the terminals on the side of one end are mutually-shifted in a staggered configuration.

The housing 20 is formed from a molded item of synthetic resin, and has a terminal holding portion 21 which holds the side of one end of each terminal 10, a back surface portion 22 which covers a back-surface side opening of the shield 30, and a pair of bottom surface portions 23 disposed on the bottom surface side on both widthwise sides of the shield 30. The terminal holding portion 21 is formed in the shape of a plate which extends forward from the back surface portion 22, and on the upper surface and lower surface thereof, there are disposed the side of one end of the upper terminal 10 and the side of one end of the lower terminal 10, respectively. A plurality of grooves 21*a* which hold each terminal 10 are provided in the upper surface and lower surface of the terminal holding portion 21, and each terminal 10 engages in the groove 21*a* in such a manner as to cause part thereof in the vertical direction to protrude from the surface of the terminal holding portion 21. A plurality of holes 22*a* through which each terminal 10 pierces in the front-back direction are provided in the back surface portion 22, and a pair of widthwise protrusions 22*b* which engage with the shield 30 are provided on the upper end surface of the back surface portion 22. Each bottom surface portion 23 is formed in such a manner as to extend forward from the back surface portion 22, and is formed so that the widthwise outer side of the inner surface forms an inclined surface obliquely upward. Furthermore, a notched portion 23*a* which engages with the shield 30 is provided on the front end side of each bottom surface portion 23.

The shield 30 is formed from a metallic cylindrical member and the front surface thereof is provided with an opening through which a mating connector is inserted. The shield 30 is made up of an inner shield member 31 disposed on the inner surface side and an outer shield member 32 disposed on the outer surface side, and the shield members 31, 32 are integrally formed from a bent metal plate, respectively. In this case, the shield 30 is formed in such a manner that the shield members 31, 32 are continuous with each other via a continuous portion 33 which is formed from part of an upper end edge of the front opening, and the continuous portion 33 is disposed in the widthwise middle of the front opening of the shield 30.

The inner shield member 31 is formed in such a manner that both widthwise ends of a metal plate abut against each other on one widthwise side surface of the shield 30, and in the abutting end portion 31*a*, there are provided a convexity 31*a*-1 and a concavity 31*a*-2 which engage with each other. A widthwise pair of first elastic pieces 31*b* are provided on the upper surface side of the inner shield member 31, and each of the first elastic pieces 31*b* is formed in such a manner as to extend backward from the front end side of the inner shield member 31. A widthwise pair of second elastic pieces 31*c* are provided on the lower surface side of the inner shield member 31, and each of the second elastic pieces 31*c* is formed in such a manner as to extend forward from the back end side of the inner shield member 31. In this case, each of the elastic pieces 31*b*, 31*c* is formed by part of the inner shield member 31, and the forward end sides thereof are each formed in such a manner as to protrude toward the inner side of the inner shield member 31. Furthermore, on widthwise both sides of the inner shield member 31, a first fixed portion 31*d* which is fixed to a board is provided, respectively, which is not shown. Each of the first fixed portions 31*d* is disposed on the back end side of the shield 30 and is formed in such a manner as to extend downward. Furthermore, at the back end on the upper surface side of the inner shield member 31, there is provided a widthwise pair of concavities 31*e* in which each of the protrusions 22*b* of the housing 20 engages.

The outer shield member 32 is formed in such a manner as to cover the upper surface and both side surfaces of the inner shield member 31, and in the upper surface thereof there is provided a widthwise pair of openings 32*a* corresponding to each of the first elastic pieces 31*b* of the inner shield member 31. On both widthwise sides of the outer shield member 32, there are provided an engaging piece 32*b* which engages with the back surface portion 22 of the housing 20, an engaging piece 32*c* which engages with the bottom surface portion 23 of the housing 20, and a second fixed portion 32*d* which is fixed to a board, which is not shown. Each of the engaging pieces 32*b* is formed in such a manner as to extend from the back end of the outer shield member 32 and is bent to the back surface side of the back surface portion 22. Each of the engaging pieces 32*c* is formed in the lower part of the outer shield member 32 on the front end side and is bent with a clearance where the front end side of the bottom surface portion 23 is disposed, arranged from the inner shield member 31, in the inner side of the outer shield member 32. In this case, each of the engaging pieces 32*c* engages in the notched portion 23*a* of each bottom surface portion 23. Each of the second fixed portions 32*d* is disposed on the front end side of the shield 30 and is formed in such a manner as to extend downward.

Figure 8:
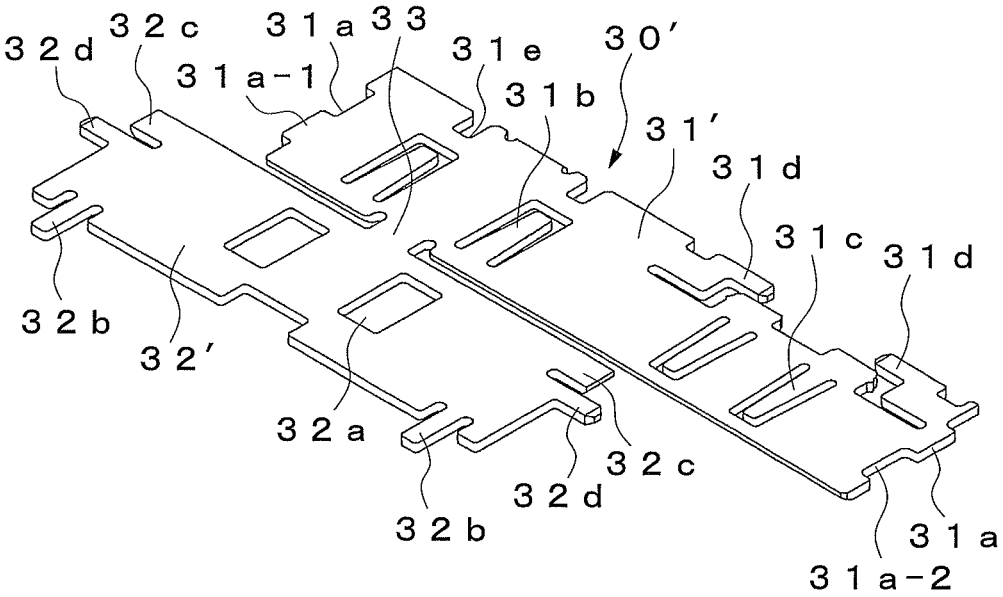
FIG. 8 is a perspective view showing the manufacturing process of a shield.
Figure 9:
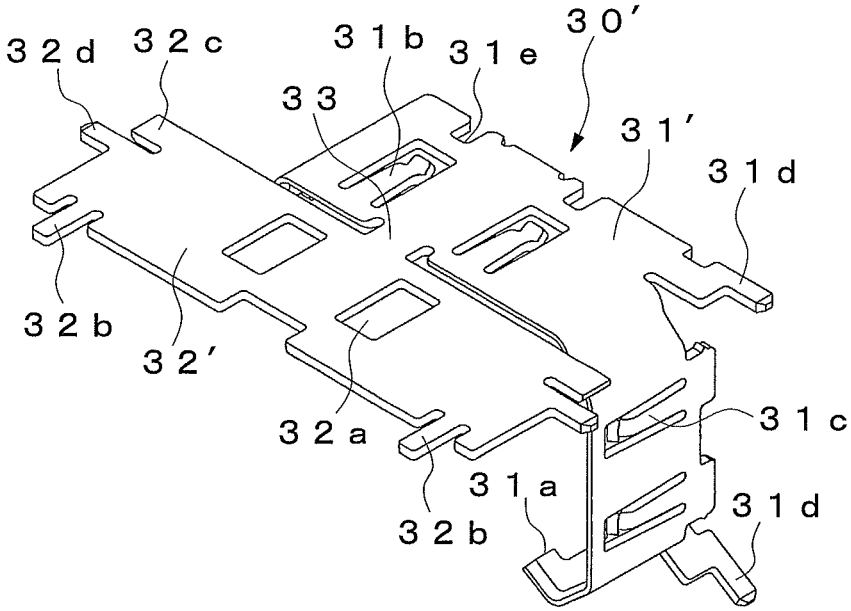
FIG. 9 is a perspective view showing the manufacturing process of a shield.
Figure 10:
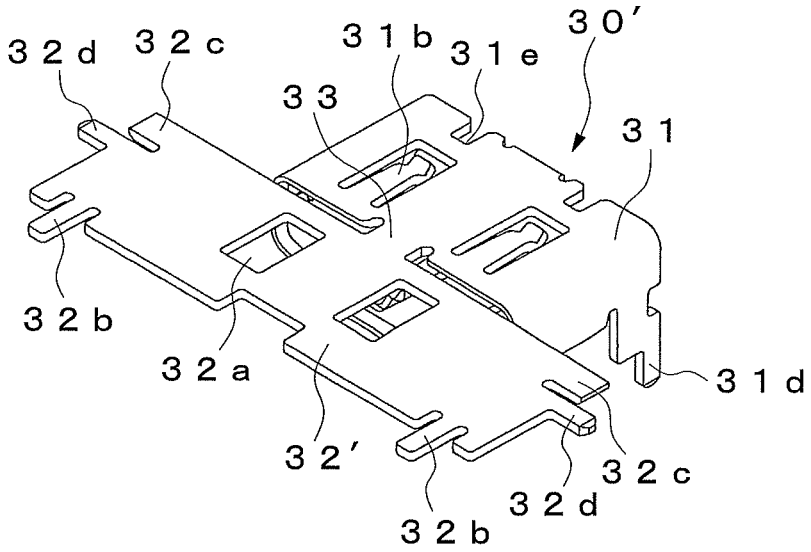
FIG. 10 is a perspective view showing the manufacturing process of a shield.
Figure 11:
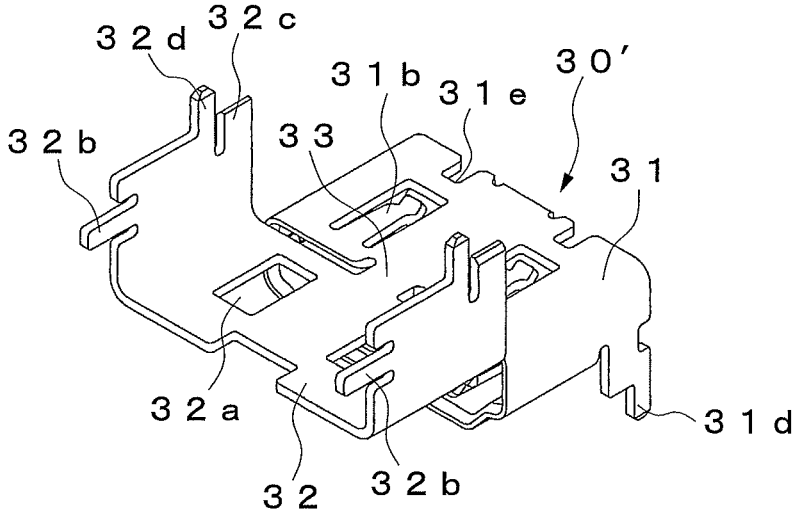
FIG. 11 is a perspective view showing the manufacturing process of a shield.
Figure 12:
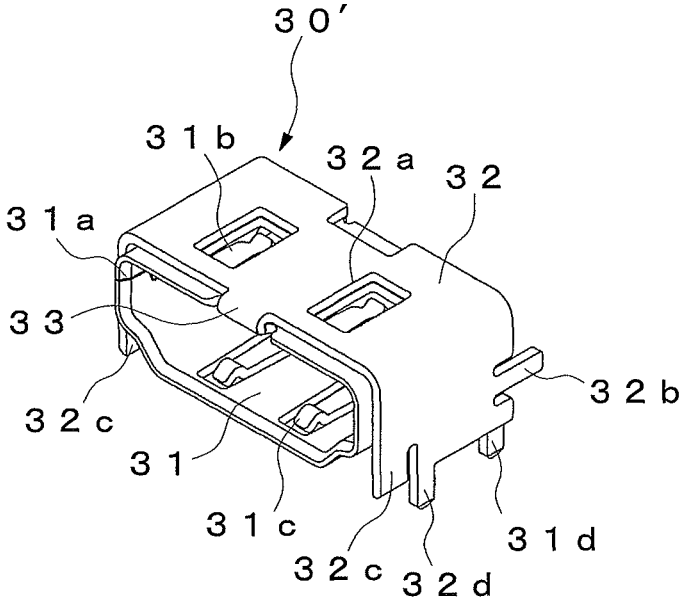
FIG. 12 is a perspective view showing the manufacturing process of a shield.
Figure 13:
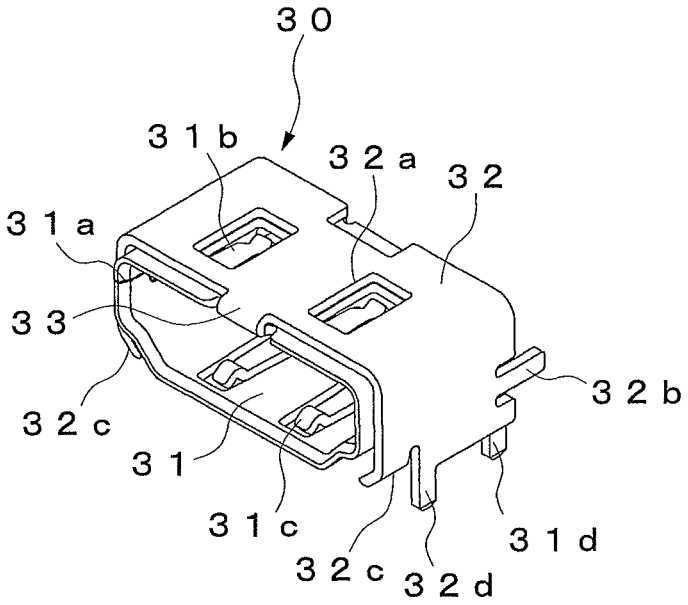
FIG. 13 is a perspective view showing the manufacturing process of a shield.

As shown in FIGS. 8 to 13, the above-described shield 30 is formed by bending a tabular metal plate 30'. As shown in FIG. 8, in the metal plate 30', by blanking there are integrally formed a first plate-like portion 31' which becomes the inner shield member 31 and a second plate-like portion 32' which becomes the outer shield member 32 as well as a first elastic piece 31*b*, a second elastic piece 31*c*, a first fixed portion 31*d*, a concavity 31*e*, an opening 32*a*, an engaging piece 32*b*, an engaging piece 32*c*, a second fixed portion 32*d*, and the continuous portion 33 which are provided in the plate-like portions 31', 32'. In forming the shield 30, first, the front end side of each of the elastic pieces 31*b*, 31*c* is bent in such a manner as to protrude in the thickness direction and thereafter both widthwise end sides of the first plate-like portion 31' are bent as shown in FIG. 9, and both widthwise ends of the first plate-like portion 31' are caused to abut against each other on one widthwise side surface of the shield 30 as shown in FIG. 10, whereby the first plate-like portion 31' is bent in a cylindrical shape to form the inner shield member 31. On that occasion, both widthwise ends of the first plate-like portion 31' are caused to abut against each other on one widthwise side surface of the shield 30, the convexity 31*a*-1 and concavity 31*a*-2 of the abutting end portion 31*a* engage with each other, and the movement of the abutting end portion 31*a* in the front-back direction is restricted. Next, as shown in FIG. 11, the outer shield member 32 is formed by bending the sides of both widthwise ends of the second plate-like portion 32' at right angles and thereafter as shown in FIG. 12 the continuous portion 33 is bent in such a manner that the second plate-like portion 32' covers the outer surface side of the inner shield member 31, whereby the outer shield member 32 is folded on the inner shield member 31. After that, as shown in FIG. 13, the shield 30 is formed by bending each of the engaging pieces 32*c* of the outer shield member 32.

The housing 20 holding each terminal 10 is inserted into the shield 30 from the back surface side. As a result of this, the side of one end of each terminal 10 held by the terminal holding portion 21 of the housing 20 is disposed in the middle of the vertical direction in the shield 30 and the back surface side opening of the shield 30 is covered with the back surface portion 22 of the housing 20. On that occasion, each of the protrusions 22*b* of the housing 20 engages in each of the concavities 31*e* of the shield 30, whereby the back surface portion 22 is positioned with respect the shield 30. Furthermore, each of the engaging pieces 32*b* of the shield 30 is bent and is caused to engage with the back surface side of the back surface portion 22, whereby the back surface portion 22 of the housing 20 is fixed to the shield 30. When the housing 20 is inserted into the shield 30, the front end side of the bottom surface portion 23 of the housing 20 becomes disposed between each of the engaging pieces 32*c* of the shield 30 and the inner shield member 31, each of the engaging pieces 32*c* engages into the notched portion 23*a* of each bottom surface portion 23, and the bottom surface portion 23 of the housing 20 is fixed by each of the engaging pieces 32*c* to the shield 30.

The connector configured as described above is such that the first and second fixed portions 31*d*, 32*d* of the shield 30 are fixed to a printed circuit board, which is not shown, and the side of the other end of each terminal 10 is connected to the board. In this connector, a mating connector, which is not shown, is inserted into the front opening of the shield 30, whereby each of the terminals 10 is connected to the mating connector. On that occasion, the first and second elastic pieces 31*b*, 31*c* of the shield 30 are pressed against the upper surface and lower surface of the mating connector and the mating connector is positively held in the shield 30.

In the case where the mating connector inclines in inserting and extracting the mating connector into and out of the shield 30, an excessive external force may sometimes be applied from the mating connector to the shield in the vertical direction or in the horizontal direction. Even in such a case, the shield 30 is not deformed easily because the shield 30 has the double structure of the inner shield member 31 and the outer shield member 32.

As described above, according to the connector of this embodiment, because the shield 30 is made up of the inner shield member 31 disposed on the inner surface side of the shield 30 and the outer shield member 32 disposed on the outer surface side of the shield 30, it is possible to increase the strength of the shield 30 thanks to the double structure of the shield members 31, 32. As a result of this, even in the case where an excessive vertical or horizontal external force is applied to the shield 30, for example, in inserting and extracting the mating connector into and out of the shield 30, the shield is not deformed easily and hence it is possible to effectively prevent the occurrence of a poor connection to the mating connector due to the deformation of the shield 30.

Furthermore, because the inner shield member 31 and outer shield member 32 of the shield 30 are formed from a bent metal plate integrally with each other, it is possible to easily manufacture the shield as an integral part without an increase in the number of parts.

In this case, because the inner and outer shield members 31, 32 are formed in such a manner as to be continuous with each other in the continuous portion 33 provided in part of the peripheral edge of the front opening of the shield 30, it is possible to superpose the inner and outer shield members on each other by bending the continuous portion 33, making it possible to form the shield 30 easily.

Furthermore, because the inner shield member 31 is formed in the shape of a cylinder which covers the upper surface, and lower surface and both side surfaces of the shield 30 and in such a manner that both widthwise ends of the first plate-like portion 31' of the metal plate 30' are caused to abut against each other on one widthwise side surface of the shield 30, even in the case where an external force which tends to widen the opening of the shield 30 is generated in the upper surface and lower surface of the shield 30 due to the horizontal inclination of the mating connector, because of the disposition of the abutting end portion 31*a* of the inner shield member 31 on one widthwise side surface of the shield 30, the abutting end portion 31*a* of the inner shield member 31 does not open and this is very favorable for an improvement in the strength against a horizontal external force.

In this case, because the movement of the abutting end portion 31*a* in the front-back direction is restricted by causing the convexity 31*a*-1 and concavity 31*a*-2 provided in the abutting end portion 31*a* of the inner shield member 31 to engage with each other, it is possible to increase the strength against the position shift of the abutting end portion 31*a* in the front-back direction.

Furthermore, because the outer shield member 32 is formed in such a manner as to cover the upper surface and both side surfaces of the inner shield member 31 and the second fixed portion 32*d* provided at both widthwise ends is fixed to a board, even in the case where an external force which tends to widen the opening of the shield 30 in the side surface of the shield 30 due to the vertical inclination of the mating connector, the abutting end portion 31*a* of the inner shield member 31 does not open because the outer shield member 32 is fixed to the board at both widthwise ends by the second fixed portion 32*d* and this is very favorable for an increase in strength against a vertical external force.

In forming the shield 30, the first plate-like portion 31' which becomes the inner shield member 31 and the second plate-like portion 32' which becomes the outer shield member 32 are integrally formed from the plate-like metal plate 30' via the continuous portion 33, the inner shield member 31 is formed by bending the first plate-like portion 31' in the form of a cylinder, the outer shield member 32 is formed by bending both widthwise end sides of the second plate-like portion 32' at right angles, and the outer shield member 32 is folded on the inner shield member 31 by bending the continuous portion 33, whereby the shield 30 is formed. Therefore, the shield 30 having the inner and outer shield members 31, 32 can be easily formed from one metal plate 30' and it is possible to achieve an improvement in productivity.

In this case, the first plate-like portion 31' and the second plate-like portion 32' are formed by blanking the plate-like metal plate 30', it is possible to easily form each of the plate-like portions 31', 32' in the metal plate 30' before bending and this is very favorable for an improvement in productivity.

REFERENCE SIGNS LIST

10 . . . Terminal, 20 . . . Housing, 30 . . . Shield, 30' . . . Metal plate, 31 . . . Inner shield member, 31' . . . First plate-like portion, 32 . . . Outer shield member, 32' . . . Second plate-like portion, 33 . . . Continuous portion

The invention claimed is:

1. A connector comprising:

a plurality of terminals disposed at mutual widthwise intervals, a terminal holding member having insulating properties and holding each terminal, and a shield having an opening on a front surface of the shield and covering the terminal holding member holding each terminal, wherein the shield is adapted to be connected to a mating connector by inserting the mating connector into the opening provided on the front surface of the shield, wherein the shield comprises an inner shield member disposed on an inner surface side of the shield and an outer shield member disposed on an outer surface side of the shield, wherein the inner shield member and the outer shield member are formed to be integral with each other by a bent metal plate, wherein the inner shield member includes an upper surface, a lower surfaces and two widthwise side surfaces, and wherein two opposite ends of the bent metal plate abut against each other at one of the two widthwise side surfaces of the inner shield member.

2. The connector according to claim 1, wherein the shield is formed in such a manner that the inner and outer shield members are continuous with each other in part of a peripheral edge of the opening on the front surface of the shield.

3. The connector according to claim 2, wherein the outer shield member covers the upper surface and the two widthwise side surfaces of the inner shield member and both widthwise ends of the outer shield member are adapted to be fixed to an object of attachment.

4. The connector according to claim 1, wherein in an abutting end portion of the inner shield member where the two opposite ends of the metal plate abut against each other at the one of the two widthwise side surfaces of the inner shield member, a convexity and a concavity are provided and engage with each other in such a manner as to restrict mutual movement in a front-back direction of the shield.

5. The connector according to claim 4, wherein the outer shield member covers the upper surface and the two widthwise side surfaces of the inner shield member and both widthwise ends of the outer shield member are adapted to be fixed to an object of attachment.

6. The connector according to claim 1, wherein the outer shield member covers the upper surface and the two widthwise side surfaces of the inner shield member and both widthwise ends of the outer shield are adapted to be fixed to an object of attachment.

7. The connector according to claim 1, wherein the outer shield member covers the upper surface and the two widthwise side surfaces of the inner shield member and both widthwise ends of the outer shield member are adapted to be fixed to an object of attachment.

8. The connector according to claim 1, wherein the inner shield member and the outer shield member are continuous with each other via a continuous portion, and opposite portions of the inner shield member relative to the continuous portion are asymmetrical

9. A method of manufacturing a connector which comprises a plurality of terminals disposed at mutual widthwise intervals, a terminal holding member having insulating properties and holding each terminal, and a shield which covers the terminal holding member holding each terminal, and in which the shield comprises an inner shield member disposed on an inner surface side of the shield and an outer shield member disposed on an outer surface side of the shield, the inner shield member including an upper surface, a lower surface, and two widthwise side surfaces, said method comprising:

forming a first plate portion defining the inner shield member and a second plate portion defining the outer shield member, wherein said first and second plate portions are integrally formed in a tabular metal plate, wherein the inner shield member is formed by bending the first plate portion into a shape of a cylinder, and wherein the outer shield member is formed by bending sides of two widthwise ends of the second plate portion at right angles, and folding the outer shield member on the inner shield member, wherein two opposite ends of the metal plate abut against each other at one of the two widthwise side surfaces of the inner shield member.

10. The method of manufacturing the connector according to claim 9, wherein the two opposite ends of the metal plate abut against each other at the one of the two widthwise side surfaces of the inner shield member in an abutting end portion of the inner shield member, mutual movement of a convexity and a concavity provided in the abutting end portion and engaged with each other in a front-back direction of the shield is restricted.

11. The method of manufacturing the connector according to claim 10, wherein the first plate portion and the second plate portion are formed by blanking in the tabular metal plate.

12. The method of manufacturing the connector according to claim 9, wherein the first plate portion and the second plate portion are formed by blanking in the tabular metal plate.

13. The method of manufacturing the connector according to claim 9, wherein the first plate portion and the second plate portion are formed by blanking in the tabular metal plate.

14. The method of manufacturing the connector according to claim 9, wherein the first plate portion and the second plate portion of the tabular metal plate are formed to be continuous with each other via a continuous portion, and opposite portions of the inner shield member relative to the continuous portion are asymmetrical.

* * * * *